US009638496B2

(12) United States Patent
Peters et al.

(10) Patent No.: US 9,638,496 B2
(45) Date of Patent: May 2, 2017

(54) ANTI-BALLISTIC HANDLING CASES, BOXES AND CONTAINERS

(71) Applicant: SHIELDPRO, LLC, Irvine, CA (US)

(72) Inventors: Fred E. Peters, Orange, CA (US); Jens Wemhoener, Aachen (DE); Peter Mowbray, Tustin, CA (US)

(73) Assignee: SHIELDPRO, LLC, Irvine, CA (US)

( * ) Notice: Subject to any disclaimer, the term of this patent is extended or adjusted under 35 U.S.C. 154(b) by 0 days.

(21) Appl. No.: 14/277,605

(22) Filed: May 14, 2014

(65) Prior Publication Data

US 2015/0184982 A1 Jul. 2, 2015

Related U.S. Application Data

(60) Provisional application No. 61/823,333, filed on May 14, 2013.

(51) Int. Cl.

| | |
|---|---|
| ***F41H 5/04*** | (2006.01) |
| ***F41H 5/08*** | (2006.01) |
| ***F42B 39/24*** | (2006.01) |
| *F41H 5/013* | (2006.01) |

(52) U.S. Cl.

CPC ..... *F41H 5/0478* (2013.01); *F41H 5/08* (2013.01); *F42B 39/24* (2013.01); *F41H 5/013* (2013.01)

(58) Field of Classification Search

CPC ..... B65D 90/32; B65D 90/325; F42B 39/00; F42B 39/14; F42B 39/20; F42B 39/22; F42B 39/24; F42B 39/26; F42B 39/30

USPC ..... 89/36.01; 220/560.01, 88.1

See application file for complete search history.

(56) References Cited

U.S. PATENT DOCUMENTS

| | | | | | |
|---|---|---|---|---|---|
| 2,601,525 | A | * | 6/1952 | Howald et al. | 220/560.02 |
| 3,304,194 | A | * | 2/1967 | Dabrowski | 428/165 |
| 4,899,420 | A | * | 2/1990 | Bye et al. | 16/16 |
| 5,031,733 | A | * | 7/1991 | Chang | 190/1 |
| 5,149,203 | A | * | 9/1992 | Sacks | 383/111 |
| 5,401,096 | A | * | 3/1995 | Stang | 312/319.2 |
| 5,464,115 | A | * | 11/1995 | Tisbo et al. | 220/324 |
| 5,551,562 | A | * | 9/1996 | Beretta | 206/317 |
| 5,776,838 | A | * | 7/1998 | Dellinger | 442/200 |
| 5,829,586 | A | * | 11/1998 | Mermell | 206/317 |
| 5,881,874 | A | * | 3/1999 | McKinney | 206/315.11 |
| 6,161,738 | A | | 12/2000 | Norris | |
| D441,954 | S | * | 5/2001 | Parker | D3/279 |

(Continued)

FOREIGN PATENT DOCUMENTS

| | | | |
|---|---|---|---|
| CN | 103884239 | A | 6/2014 |
| GB | 2242619 | A | 9/1991 |
| WO | 2012018986 | A1 | 2/2012 |

OTHER PUBLICATIONS

Extended European Search Report received in related European patent application No. 14798568.3 dated Nov. 11, 2016, 7 pages.

*Primary Examiner* — Joshua Freeman

(74) *Attorney, Agent, or Firm* — Procopio, Cory, Hargreaves & Savitch LLP; Noel C. Gillespie

(57) ABSTRACT

An Anti-Ballistic Handling Case including a body having a plurality of body side walls forming a hollow interior region; a lid having a plurality of a lid side walls, wherein the lid is attached to the body and configured to cover the body portion to enclose the hollow interior region of the body; and an anti-ballistic portion disposed adjacent to at least one of the plurality of body side walls, and the plurality of lid side walls.

40 Claims, 6 Drawing Sheets

(56) References Cited

U.S. PATENT DOCUMENTS

| | | | | |
|---|---|---|---|---|
| D465,330 | S * | 11/2002 | Parker | D3/273 |
| 6,955,381 | B2 * | 10/2005 | Parker et al. | 292/113 |
| 8,701,544 | B2 * | 4/2014 | Peters et al. | 89/918 |
| 2003/0189047 | A1 | 10/2003 | McHutchinson | |
| 2005/0197020 | A1 * | 9/2005 | Park et al. | 442/36 |
| 2007/0107118 | A1 * | 5/2007 | Tudor | 4/498 |
| 2008/0047860 | A1 * | 2/2008 | Shane | 206/317 |
| 2011/0259692 | A1 * | 10/2011 | Warncke et al. | 190/124 |
| 2012/0130534 | A1 * | 5/2012 | Wurm | 700/236 |
| 2013/0041288 | A1 * | 2/2013 | Taylor et al. | 600/587 |
| 2014/0000495 | A1 * | 1/2014 | Spencer | 109/56 |
| 2014/0054297 | A1 * | 2/2014 | Patstone | 220/592.01 |

* cited by examiner

ANTI-BALLISTIC HANDLING CASES, BOXES AND CONTAINERS

CROSS-REFERENCE TO RELATED APPLICATIONS

This application claims a benefit of priority from Provisional U.S. Patent application Ser. No. 61/823,333, filed May 14, 2013, the contents of which are incorporated by reference.

FIELD

This application provides a unique construction of Handling Cases, Carrier Boxes and Containers, and more particularly, cases, boxes, storage containers and shipping containers have one or more sides made from or having an anti-ballistic portion.

BACKGROUND

Bulletproofing is the process of making something capable of stopping a bullet or similar high velocity projectiles e.g. shrapnel. The term bullet resistance is often preferred because few, if any, practical materials provide complete protection against all types of bullets, or multiple hits in the same location. Bullet designs vary widely, not only according to the particular firearm used (e.g. a 9×19 mm Parabellum caliber hollow point handgun cartridge will have inferior penetration power compared to a 7.62×39 mm assault rifle cartridge), but also within individual cartridge designs. As a result, while some so-called "bullet-proof" panels may successfully prevent penetration by standard 7.62×39 mm bullets containing lead cores, the same panels may easily be defeated by 7.62×39 mm armor piercing bullets containing hardened steel penetrators.

Bullet-resistant materials, also called ballistic materials or, equivalently, Anti-Ballistic materials, are usually rigid, but may be supple. They may be complex, such as KEVLAR® LEXAN®, and carbon fiber composite materials, or they may be basic and simple, such as steel or titanium. Bullet resistant materials are often used in law enforcement and military applications, to protect personnel from death or serious injuries.

There is a growing need for methods of self-protection in an increasingly wide variety of locations. In the modern world, crimes and attacks committed by persons with guns are an ever more common occurrence. In the past, police personnel and military personnel have been the primary targets of gunfire which has been directed toward them during work or duty. Because of this continual risk of harm, bullet resistant vests and shields have been developed which may be deployed or worn on the user's body as a protective component of their work attire. Such devices, when employed for protection against weapons fire have worked fairly well in preventing a high velocity bullet or shell from penetrating the wearer's body since the velocity is slowed considerably.

It has been made evident by recent shootings, such as Fort Hood, there may be a need for additional means of self-protection. This mass shooting took place on Nov. 5, 2009, at Fort Hood, the most populous U.S. military installation in the world, located just outside Killeen, Tex. In the course of the shooting, a single gunman killed 13 people and wounded 29 others.

In locations where goods or equipment are moved, stored or loaded the working personnel may be able to hide behind handling cases, carrier boxes and containers in the event of gunfire. Due to the required weight saving design, these handling cases, carrier boxes and containers often have side walls made from wood, plastic or other thin-walled, light metal. Frequently, handgun and rifle bullets may be able to penetrate these materials and severely injure or even kill the working personnel hiding behind the cases, boxes and containers.

New materials and improvements of manufacturing processes may allow items such Anti-Ballistic cases to become a practical item. Previously, bullet-proof vests have been constructed by applying multiple layers of fabric woven from an aramid fiber together, which is sold by Du Pont under the Trademark KEVLAR. It can be used in a flexible state or laminated in a more rigid configuration. The success of the product is attained by multiple layers of the semi-impregnable flexible structure. This material combines high penetration resistance with lightness and flexibility but no one has endeavored to manufacture items like cases, boxes, storage containers and shipping containers using this material.

As should be understood that embodiments of the present application are not limited to the derails of construction and to the arrangement of the components or the steps set forth in the following description or illustrated in the drawings. The various alternatives or combinations of the features shown or described herein may be incorporated into other embodiments and practiced and carried out in various ways, which might be apparent to those skilled in the art once the information herein is reviewed. Also, it is to be understood that the phraseology and terminology employed herein are for the purpose of description, and should not be regarded as limiting in any fashion. As such, those skilled in the art will appreciate that the conception upon which this disclosure is based may readily be utilized as a basis for designing other furniture type ballistic shields for carrying out the several purposes of the present disclosed device and method. It is important, therefore, that the embodiments, objects and claims herein, be regarded as including such equivalent construction and methodology insofar as they do not depart from the spirit and scope of the present invention.

The present disclosure is directed toward overcoming one or more of the problems discovered by the inventors.

SUMMARY

An embodiment of the present application may provide an anti-ballistic handling case including a body having a plurality of body side walls forming a hollow interior region; a lid having a plurality of a lid side walls, wherein the lid is attached to the body and configured to cover the body portion to enclose the hollow interior region of the body; and an anti-ballistic portion disposed adjacent to at least one of the plurality of body side walls, and the plurality of lid side walls.

Another embodiment of the present application may provide An Anti-Ballistic container including a body forming a hollow interior region, the body including a frame, and a plurality of body side walls attached to the frame, a lid having a plurality of a lid side walls, wherein the lid is attached to the body and configured to cover the body portion to enclose the hollow interior region of the body; and an anti-ballistic portion formed of an anti-ballistic material disposed adjacent to at least one of: the plurality of body side walls, and the plurality of lid side walls.

Other features of the present application will become more readily apparent to those of ordinary skill in the art after reviewing the following detailed description and accompanying drawings.

BRIEF DESCRIPTION OF THE DRAWINGS

A general architecture that implements the various features of the disclosure will now be described with reference to the drawings. The drawings and the associated descriptions are provided to illustrate embodiments of the disclosure and not to limit the scope of the disclosure. Throughout the drawings, reference numbers are reused to indicate correspondence between referenced elements.

DETAILED DESCRIPTION

Figure 1:
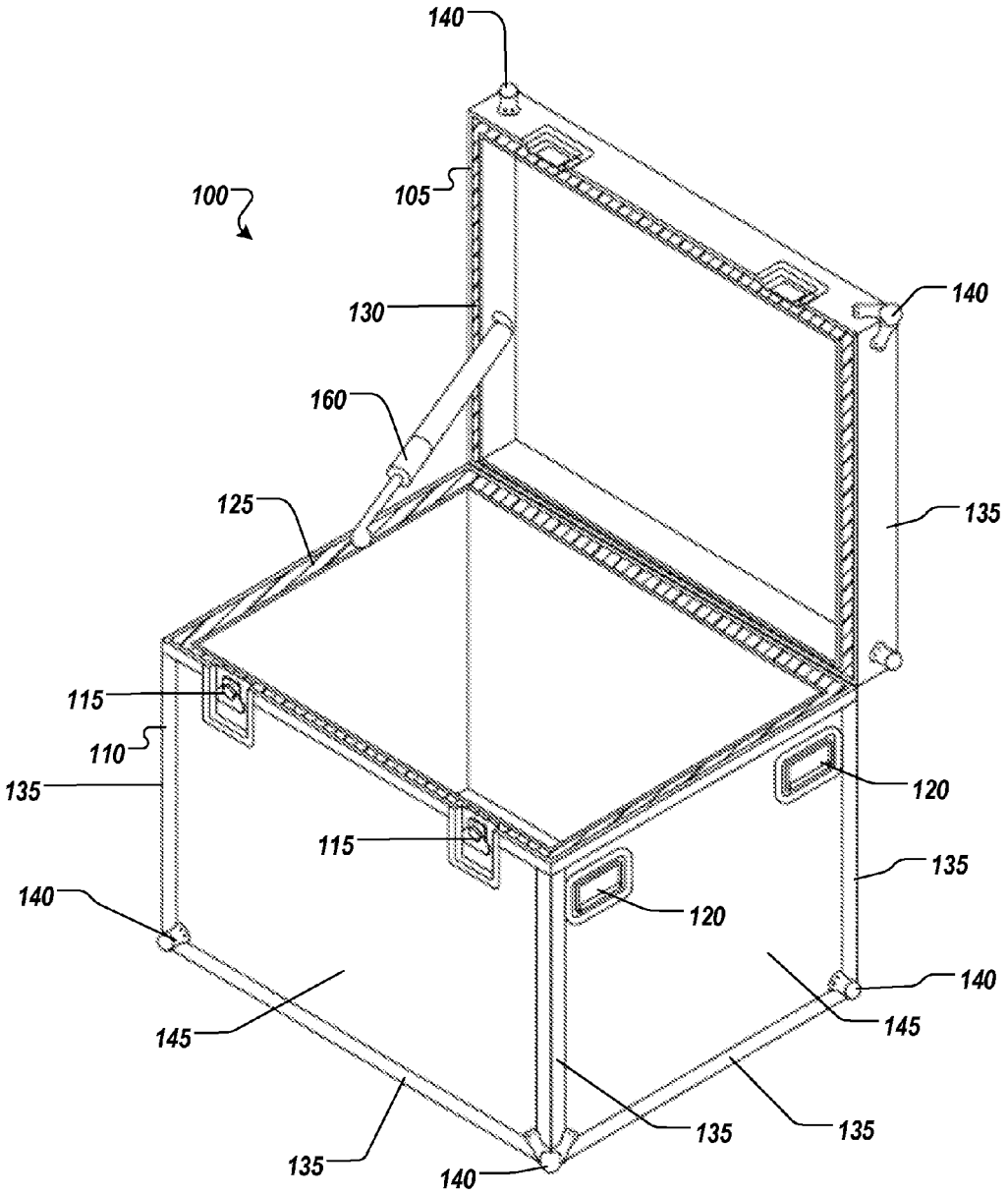
FIG. 1 depicts a perspective view of an Anti-Ballistic Handling Case according to one embodiment of the present application.
Figure 2:
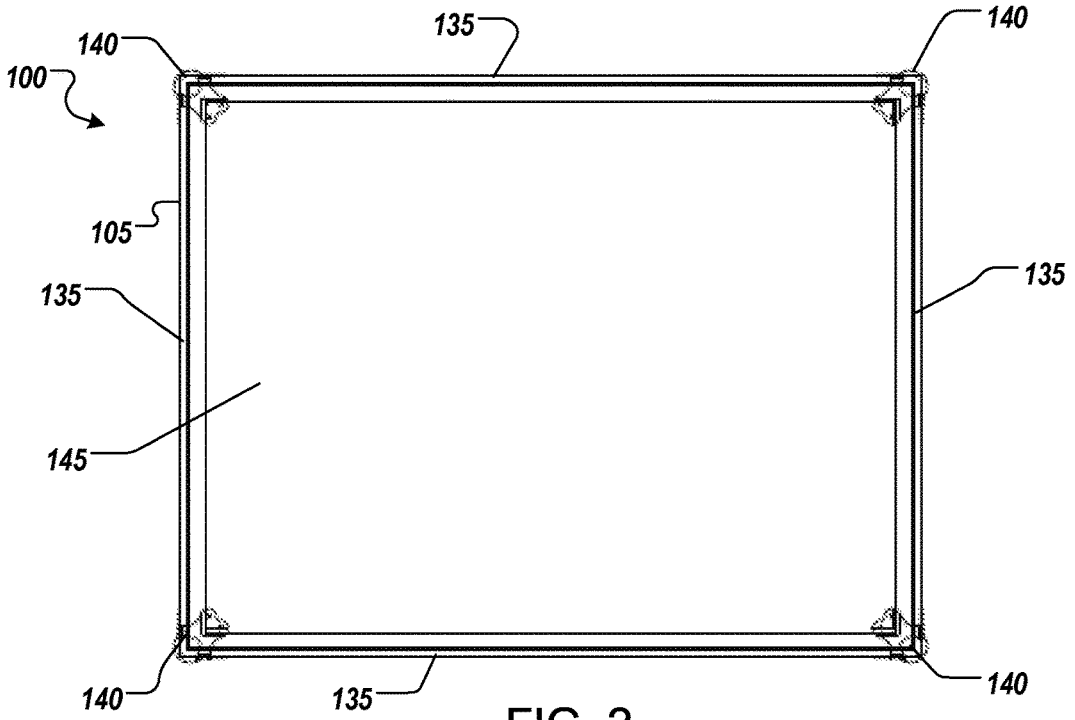
FIG. 2 depicts a top view of the Anti-Ballistic Handling Case of FIG. 1.
Figure 3:
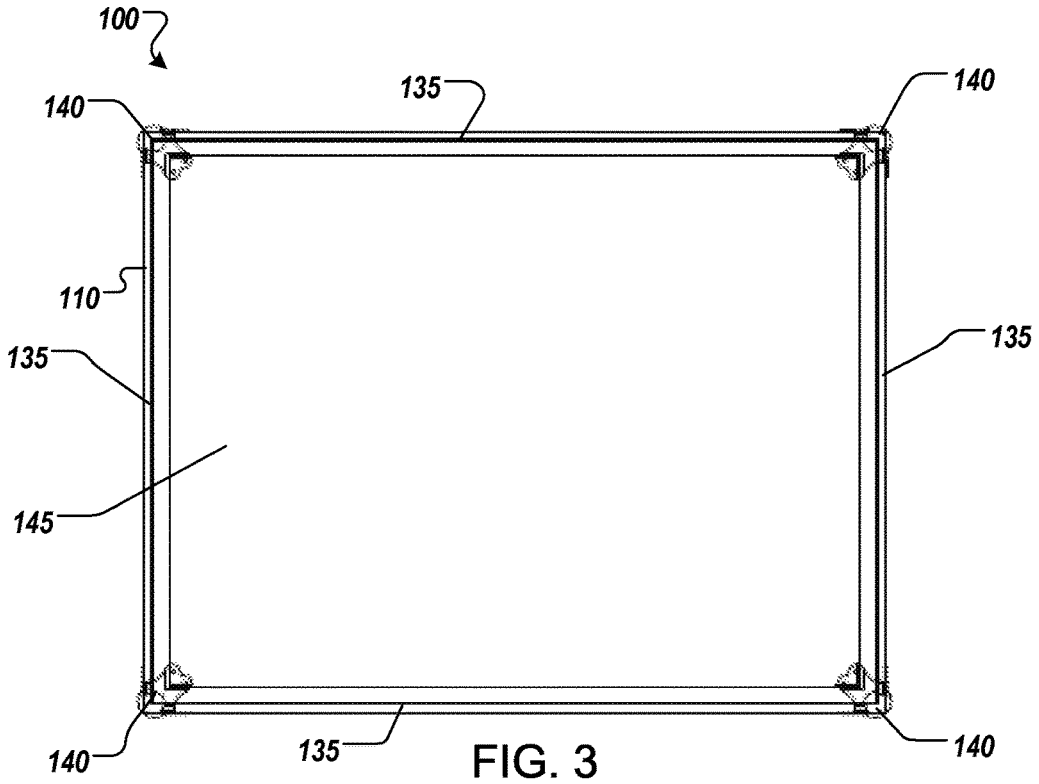
FIG. 3 depicts a bottom view of the Anti-Ballistic Handling Case of FIG. 1.
Figure 4:
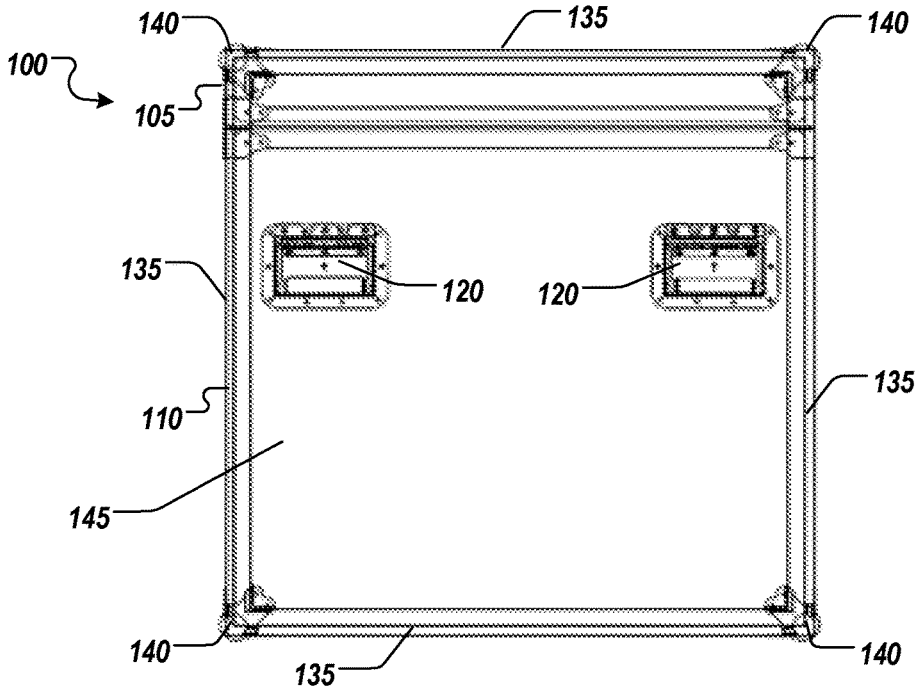
FIGS. 4 and 5 depict side views of the Anti-Ballistic Handling Case of FIG. 1.
Figure 5:
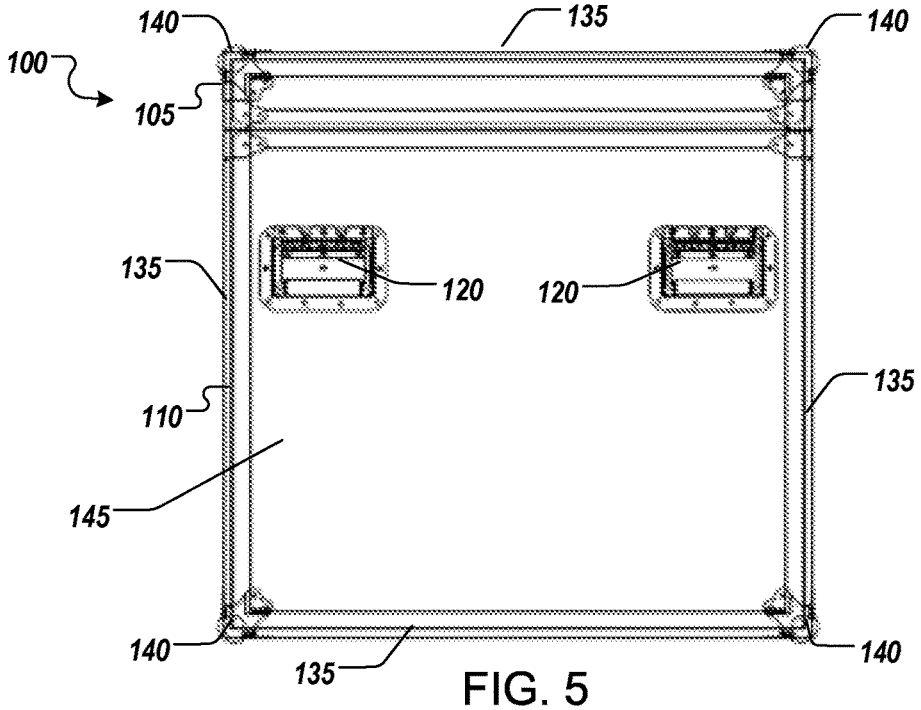
Figure 6:
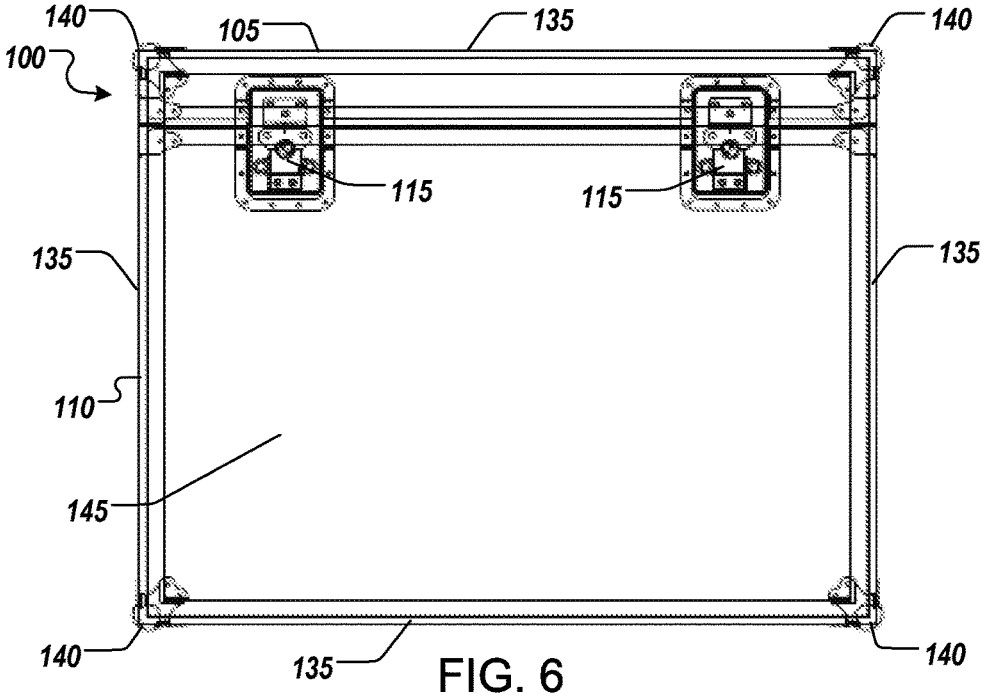
FIG. 6 depicts a front view of the Anti-Ballistic Handling Case of FIG. 1.
Figure 7:
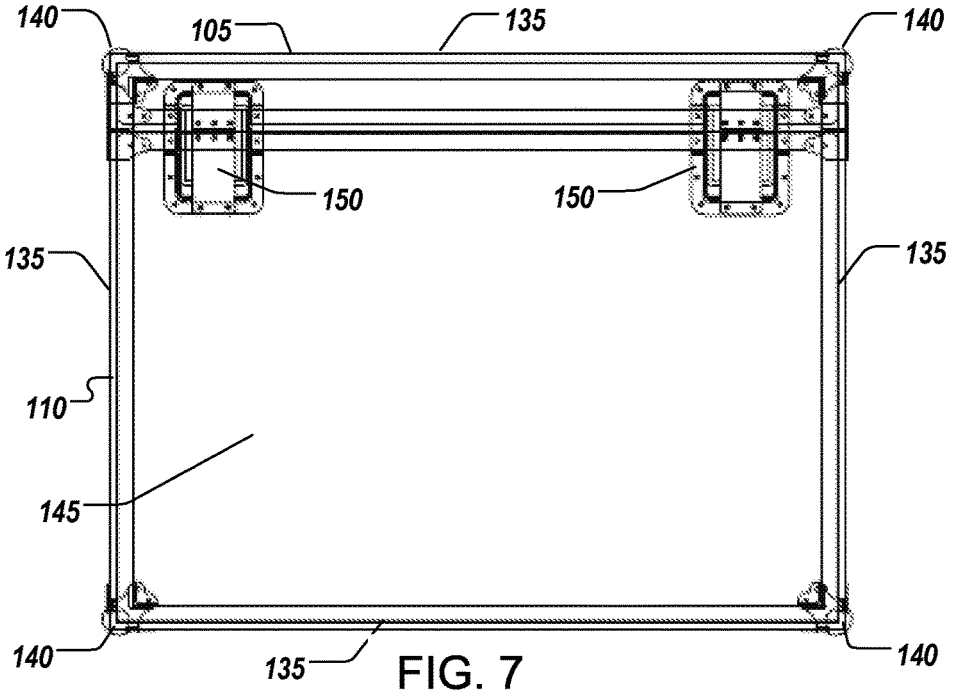
FIG. 7 depicts a rear view of the Anti-Ballistic Handling Case of FIG. 1.

FIG. 1 depicts a perspective view of an Anti-Ballistic Handling Case 100 according to one embodiment of the present application in an open configuration. Additionally, FIGS. 2 and 3 depict top and bottom views, respectively, of the Anti-Ballistic Handling Case 100 of FIG. 1 in a closed configuration. Further, FIGS. 4 and 5 depict side views of the Anti-Ballistic Handling Case 100 of FIG. 1 in a closed configuration. Further, FIGS. 6 and 7 depict, front and rear views, respectively, of the Anti-Ballistic Handling Case 100 of FIG. 1 in a closed configuration.

As illustrated, the Anti-Ballistic Handling Case 100 includes a lid 105 and a body 110 connected to the body with the help of two or more hinges 150. In this embodiment, both the lid 105 and the body 110 are formed by a frames formed by a plurality of metallic extruded sections 135 joined together by metallic corner connectors 140. The materials of the metallic extruded sections 135 and metallic corner connectors 140 are not particularly limited, and may include steel, aluminum, brass, iron, or any other metal as may be apparent to a person of ordinary skill in the art. Further, the extruded sections 135 and corner connectors 140 are not required to be formed from metal and may instead be formed from other materials including polymers, resins, ceramics or other materials as may be apparent to a person of ordinary skill in the art.

The lid 105 and body 110 also includes side panels 145 attached to extruded sections 135 and corner connectors 140 to form a solid box-like structure. In some embodiments, the side panels 145 may be attached to the extruded sections 135 and corner connectors 140 by epoxy, glue, or other adhesive. In other embodiments, the side panels 145 may be attached to the extruded sections 135 and corner connectors 140 by screws, nails, bolts, nuts, or other fastener. In still other embodiments, the side panels 145 may be attached to the extruded sections 135 and corner connectors 140 by one or more retaining features, such as grooves, notches, etc. formed in the extruded sections 135 and corner connectors 140.

Though this embodiment includes extruded sections 135 and corner connectors 140 forming a frame to which the side panels 145 are attached, embodiments of the present application are not required to have extruded sections 135 or corner connectors 140. Instead, the side panels 145 may be directly attached to each other using adhesive, brackets, fastening members, or other connecting mechanisms without a frame, as might be apparent to a person of ordinary skill in the art.

The material construction of the side panels 145 is not particularly limited and may include the side panels 145 being formed from wood, metal, resin, polymer, ceramic, composite or other material as may be apparent to a person of ordinary skill in the art.

In some embodiments, the Anti-ballistic case 100 may also incorporate struts 160 to hold the lid 105 open at one or more angles between a fully open and a fully closed configuration (i.e. a 90° opening, a 135° opening, a 180° opening, etc.). Further in some embodiments, the struts 160 may be collapsible struts having 2 or more pieces that move relative to each other to change the length of the strut 160. Further in some embodiments, the struts 160 may be automatic struts, which can be remotely actuated to open and/or close the lid 105. For example, the Anti-ballistic case 100 may be automatic struts 160 that open and/or close the lid 105 when a remote is activated by a user.

As illustrated in FIG. 1, a single strut 160 may be provided on one side of the Anti-ballistic case 100. However, other embodiments may have a pair of struts, each strut being located on opposite sides of the Anti-ballistic case 100. Other embodiments may also have more than two struts as might be apparent to a person of ordinary skill in the art.

Additionally, in some embodiments, the Anti-Ballistic Case 100 may also have one or more handgrips 120 located on one or more sides of the Anti-Ballistic Case 100. As illustrated in FIGS. 4 and 5, two handgrips 120 are provided on each of the short sides of the body 110. Other embodiments may include only a single hand grip or more than two handgrips being provided on each of the short sides of the body 110. Still other embodiments may include one or more hand grips being provided on one or more of: (1) the long sides of the body 110, (2) the bottom of the body 110, and/or (3) the top of the lid 105. Additionally, embodiments of the Anti-Ballistic cases 100 may include one or more tie-down points for receiving ropes, straps, or retaining mechanisms to allow the Anti-Ballistic case to be strapped to a cargo carrier on an air, land, or sea vehicle formed on one or more of: (1) the short sides of the body 110, (2) the long sides of the body 110, (3) the bottom of the body 110, and/or (4) the top of the lid 105. Further, embodiments of the Anti-Ballistic case 100 may also include one or more hook or lift points for lifting the Anti-Ballistic Case 100 using a crane, forklift, or other piece of heavy machinery.

Additionally, in some embodiments, the Anti-Ballistic Case 100 may also include wheels attached to bottom to allow the Anti-Ballistic Case to be rolled along surfaces. The type of wheel is not particularly limited and may include low friction wheels, roller bearing wheels or any other type of wheel that may be apparent to a person of ordinary skill in the art.

As illustrated in FIG. 1, the Anti-Ballistic Case 100 also includes an Anti-Ballistic body portion 125 and an Anti-Ballistic lid portion 130. The Anti-Ballistic body portion 125 is illustrated inserted into the body 110 of the Anti-Ballistic Case 100. The Anti-Ballistic lid portion 130 is illustrated inserted into the Lid 105. The Anti-Ballistic body portion 125 and Anti-Ballistic lid portion 130 are discussed in greater detailed below with respect to FIGS. 8-11.

As illustrated in FIG. 6, the Anti-Ballistic Case 100 may also include one or more locking mechanisms 115 located on a front face of the Anti-Ballistic Case 100 to hold the lid 105 to the body 110 in a closed configuration. The locking mechanism 115 may include be key locks, combination locks, biometric locks, remotely actuated locks or any other locking mechanism as may be apparent to a person of ordinary skill in the art. In this embodiment, two locking mechanisms 115 are provided on the front face of the Anti-Ballistic Case 100. However, in other embodiments, a single locking mechanism, or 3 or more locking mechanisms may be provided. Additionally, in some embodiments, one or more locking mechanisms may be provided on the side faces, rear face or any other portion of the Anti-Ballistic Case 100 as may be apparent to a person of ordinary skill in the art.

As illustrated in FIG. 7, the lid 105 is connected to body 110 by a pair of hinges 150 located on a rear side of the Anti-Ballistic Case 100. In some embodiments, the hinges 150 may be spring loaded to assist in opening of the lid 105 and/or hold the lid 105 open.

Figure 8:
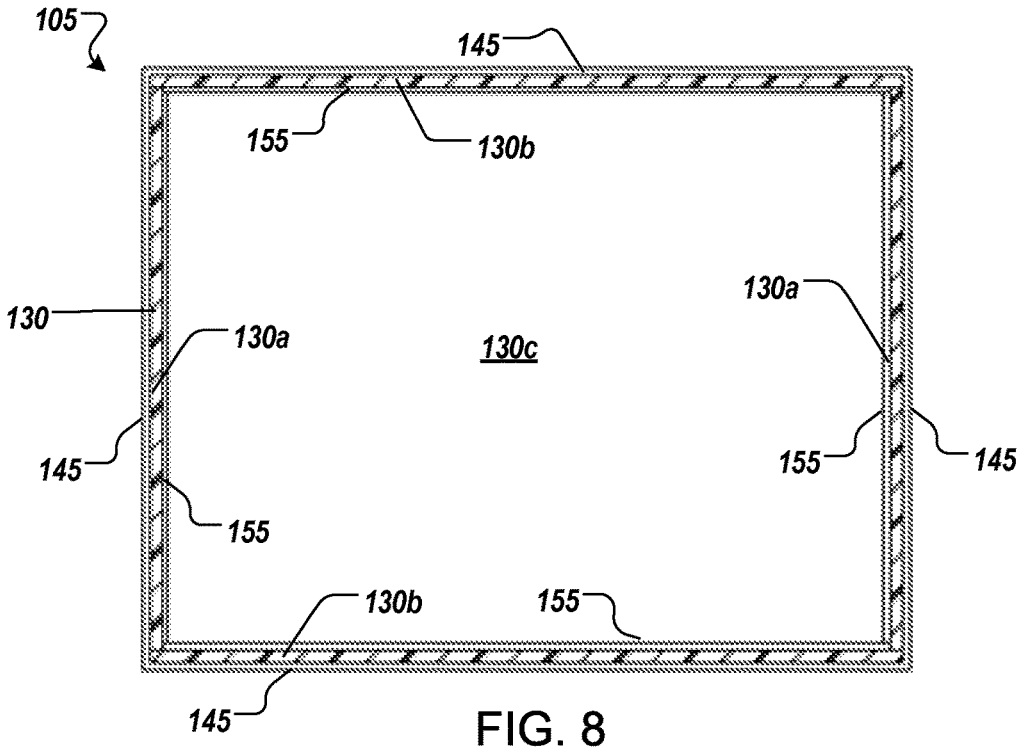
FIG. 8 depicts a cross-sectional top view of a lid of the Anti-Ballistic handling case of FIG. 1
Figure 11:
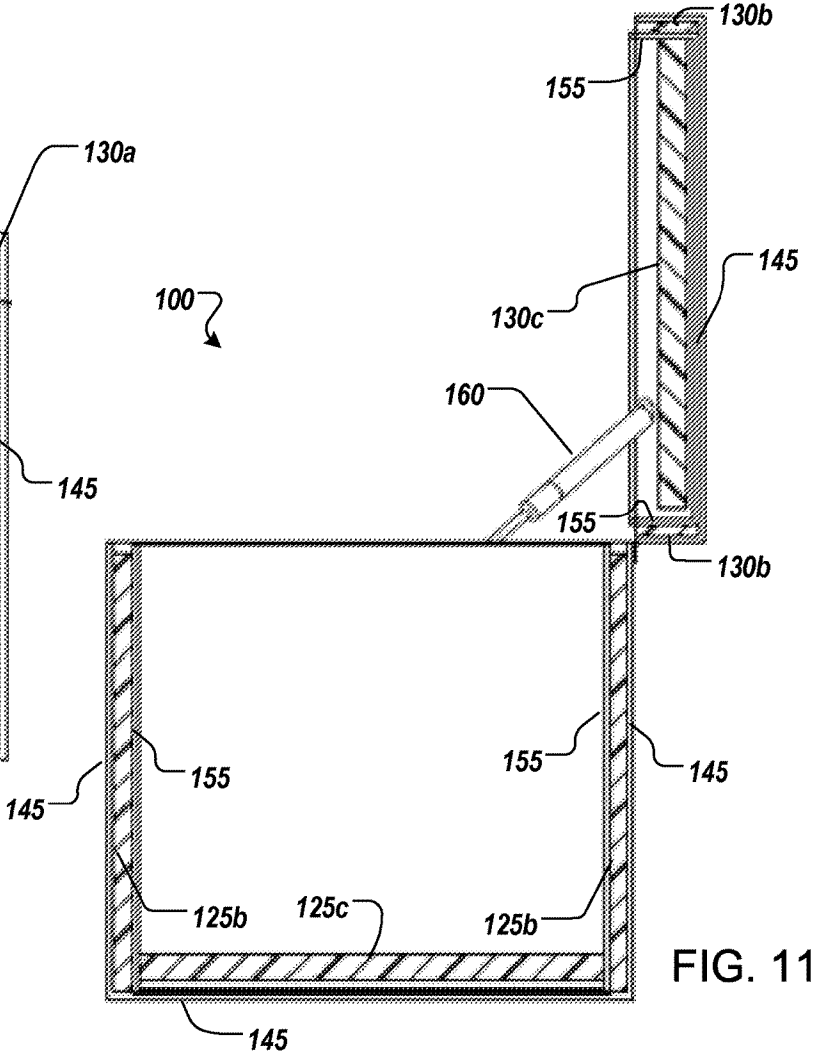
FIG. 11 depicts a cross-sectional side view of the Anti-Ballistic handling case of FIG. 1.
Figure 10:
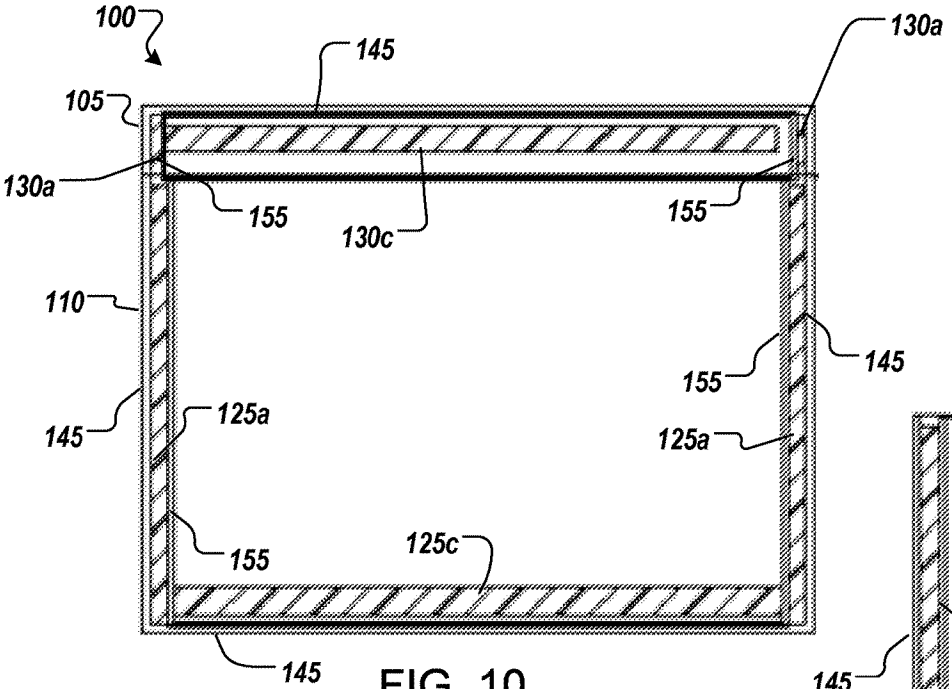
FIG. 10 depicts a cross-sectional front view of the Anti-Ballistic handling case of FIG. 1.

FIG. 8 depicts a cross-sectional top view of the lid 105 of the Anti-Ballistic handling case 100 of FIG. 1. Additionally, FIGS. 10 and 11 depict cross-sectional front and side views of the Anti-Ballistic handling case 100 including the lid 105 of FIG. 1. As illustrated, the lid 105 includes an Anti-Ballistic lid portion 130 inserted therein. The Anti-Ballistic lid portion 130 includes a pair of Anti-Ballistic short side panels 130*a*, a pair of Anti-Ballistic long side panels 130*b*, and an Anti-Ballistic top side panel 130*c*. In some embodiments, the Anti-Ballistic short side panels 130*a*, Anti-Ballistic long side panels 130*b*, and Anti-Ballistic top side panel 130*c* may be attached to each other to form a single insert piece that can be placed in the lid 105 of the Anti-Ballistic handling case 100. In such embodiments, the Anti-Ballistic short side panels 130*a*, Anti-Ballistic long side panels 130*b*, and Anti-Ballistic top side panel 130*c* may be attached together by adhesive (such as glue, epoxy, etc.), fasteners (such as nails, screws, bolts, etc.), welding, crimping, or any other attachment mechanism as may be apparent to a person of ordinary skill in the art.

In other embodiments, each of the Anti-Ballistic short side panels 130*a*, Anti-Ballistic long side panels 130*b*, and Anti-Ballistic top side panel 130*c* may be separately attached to the lid 105 of the Anti-Ballistic Case 100. For example, the Anti-Ballistic short side panels 130*a* may be positioned adjacent to the sidewalls 145 of the short side of the lid 105 and attached there to by adhesive (such as glue, epoxy, etc.), fasteners (such as nails, screws, bolts, etc.), welding, crimping, or any other attachment mechanism as may be apparent to a person of ordinary skill in the art.

Additionally, the Anti-Ballistic long side panels 130*b* may be positioned adjacent to the sidewalls 145 of the long side of the lid 105 and attached there to by adhesive (such as glue, epoxy, etc.), fasteners (such as nails, screws, bolts, etc.), welding, crimping, or any other attachment mechanism as may be apparent to a person of ordinary skill in the art.

Further, the Anti-Ballistic top side panel 130*c* may be positioned adjacent to the sidewall 145 of the top of the lid 105 attached there to by adhesive (such as glue, epoxy, etc.), fasteners (such as nails, screws, bolts, etc.), welding, crimping, or any other attachment mechanism as may be apparent to a person of ordinary skill in the art.

Additionally, the lid 105 may also include an inner liner or sidewall 155 that is positioned within the Anti-Ballistic lid portion 130. The inner liner or sidewall 155 may provide an inner frame to hold the Anti-Ballistic Lid portion 130 in place between the lid 105 and the inner liner/sidewall 155.

Each of the Anti-Ballistic short side panels 130*a*, Anti-Ballistic long side panels 130*b*, and Anti-Ballistic top side panel 130*c* may be formed from a variety of constructions. For Example, each panel may be formed by wrapping high strength synthetic fibers such as aramid around an internal frame in at least two different directions. For example, in one embodiment, aramid fiber protective material may be wrapped around a frame in a horizontal direction to form horizontal layers of the aramid fiber protective material. Further, the aramid fiber protective material may also be wrapped around the frame in a vertical direction to form vertical layers of the aramid fiber protective material. In such an embodiment, the horizontal layers and vertical layers cross at a substantially 90° angles, but embodiments of this application need not have the layers cross at substantially 90° angles, but could instead cross at angles less than or greater than 90°.

In other embodiments, including a variety of soft materials along with hard surfaced resin impregnated laminated Anti-Ballistic materials, such as those sold by Du Pont under the registered trademark KEVLAR® and will still remain within the scope of this application.

Additionally, Each of the Anti-Ballistic short side panels 130*a*, Anti-Ballistic long side panels 130*b*, and Anti-Ballistic top side panel 130*c* may also be fabricated using not only aramid fibers and KEVLAR® from DuPont, but also polyethylene fibers and GOLD SHIELD®, which is a KEVLAR® based material, and SPECTRA SHIELD®, which is polyethylene based material, both available commercially from Honeywell. GOLD SHIELD® and SPECTRA SHIELD® are high strength synthetic fibers impregnated in partially cured resin for use in ballistic material.

Moreover, both of the Honeywell materials can be used as layered soft armor or can be resin bonded, hot dye pressed synthetic fibers to form hard armor when they are autoclaved or compression molded into Anti-Ballistic components for construction of one or more of the Anti-Ballistic short side panels 130*a*, Anti-Ballistic long side panels 130*b*, and Anti-Ballistic top side panel 130*c*.

Additionally, in some embodiments, one or more of one or more of the Anti-Ballistic short side panels 130*a*, Anti-Ballistic long side panels 130*b*, and Anti-Ballistic top side panel 130*c* may be formed from a transparent Anti-Ballistic material such as a bullet proof glass or polycarbonate material such as materials sold by Saint-Gobain-Sully under the trade names ""Diamant" and/or "security glass", which are typically used in commercial armored vehicles and security trucks. For example, the top panel 130*c* may be formed from a transparent Anti-Ballistic Material in some embodiments. In such an embodiment, the outer sidewall 145 on the top of the lid may be omitted so that a transparent, Anti-Ballistic window is formed in the top of the Anti-Ballistic Case 100.

Other similar materials or configurations of materials with similar purpose and function may be readily apparent to a person of ordinary skill in the art.

Figure 9:
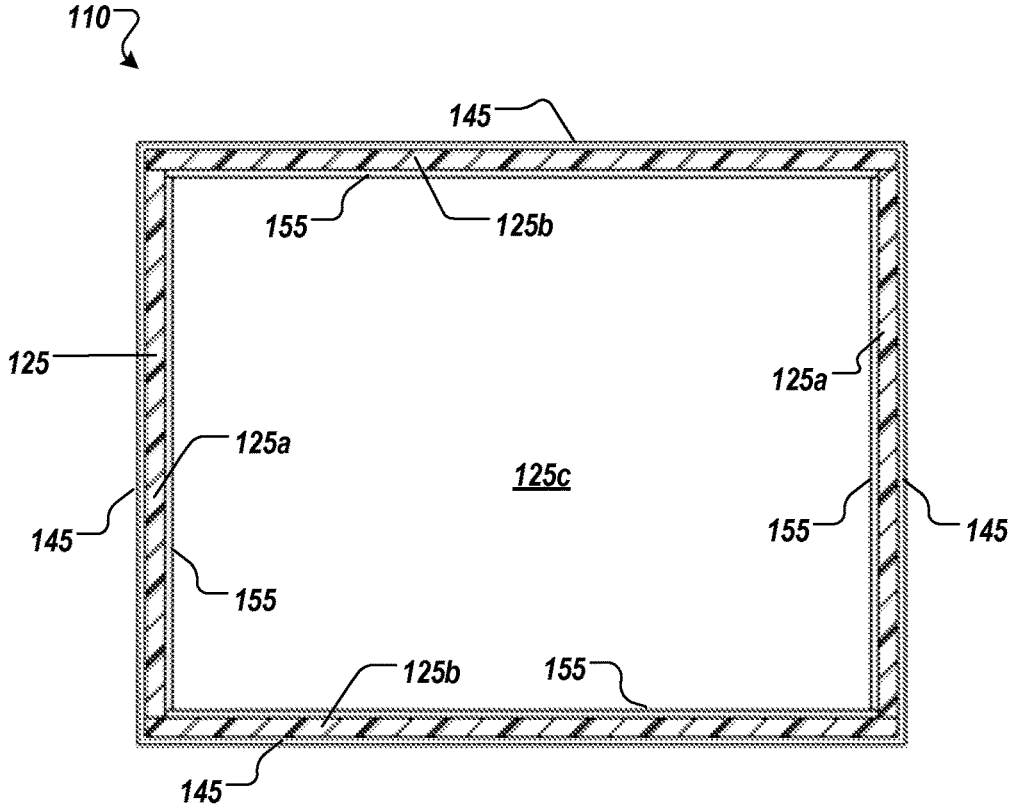
FIG. 9 depicts a cross-sectional top view of a body of the Anti-Ballistic handling case of FIG. 1.

Further, FIG. 9 depicts a cross-sectional top view of a body 110 of the Anti-Ballistic handling case 100 of FIG. 1. Again, FIGS. 10 and 11 depict cross-sectional front and side views of the Anti-Ballistic handling case 100 including the body 110 of FIG. 1. As illustrated, the body 110 includes an Anti-Ballistic body portion 125 inserted therein. The Anti-Ballistic body portion 125 includes a pair of Anti-Ballistic short side panels 125*a*, a pair of Anti-Ballistic long side panels 125*b*, and an Anti-Ballistic bottom side panel 125*c*. In some embodiments, the Anti-Ballistic short side panels 125*a*, Anti-Ballistic long side panels 125*b*, and Anti-Ballistic bottom side panel 125*c* may be attached to each other to form a single insert piece that can be placed in the body 110 of the Anti-Ballistic handling case 100. In such embodiments, the Anti-Ballistic short side panels 125*a*, Anti-Ballistic long side panels 125*b*, and Anti-Ballistic bottom side panel 125*c* may be attached together by adhesive (such as glue, epoxy, etc.), fasteners (such as nails, screws, bolts, etc.), welding, crimping, or any other attachment mechanism as may be apparent to a person of ordinary skill in the art.

In other embodiments, each of the Anti-Ballistic short side panels 125*a*, Anti-Ballistic long side panels 125*b*, and Anti-Ballistic bottom side panel 125*c* may be separately attached to the body 110 of the Anti-Ballistic Case 100. For example, the Anti-Ballistic short side panels 125*a* may be positioned adjacent to the sidewalls 145 of the short side of the body 110 and attached there to by adhesive (such as glue, epoxy, etc.), fasteners (such as nails, screws, bolts, etc.), welding, crimping, or any other attachment mechanism as may be apparent to a person of ordinary skill in the art.

Additionally, the Anti-Ballistic long side panels 125*b* may be positioned adjacent to the sidewalls 145 of the long side of the body 110 and attached there to by adhesive (such as glue, epoxy, etc.), fasteners (such as nails, screws, bolts, etc.), welding, crimping, or any other attachment mechanism as may be apparent to a person of ordinary skill in the art.

Further, the Anti-Ballistic bottom side panel 125*c* may be positioned adjacent to the sidewall 145 of the top of the lid 105 attached there to by adhesive (such as glue, epoxy, etc.), fasteners (such as nails, screws, bolts, etc.), welding, crimping, or any other attachment mechanism as may be apparent to a person of ordinary skill in the art.

Additionally, the body 110 may also include an inner liner or sidewall 155 that is positioned within the Anti-Ballistic body portion 125. The inner liner or sidewall 155 may provide an inner frame to hold the Anti-Ballistic body portion 125 in place between the body 110 and the inner liner/sidewall 155.

Each of the Anti-Ballistic short side panels 125*a*, Anti-Ballistic long side panels 125*b*, and Anti-Ballistic bottom side panel 125*c* may be formed from a variety of constructions. For example, each panel may be formed by wrapping high strength synthetic fibers such as aramid around an internal frame in at least two different directions. For example, in one embodiment, aramid fiber protective material may be wrapped around a frame in a horizontal direction to form horizontal layers of the aramid fiber protective material. Further, the aramid fiber protective material may also be wrapped around the frame in a vertical direction to form vertical layers of the aramid fiber protective material. In such an embodiment, the horizontal layers and vertical layers cross at a substantially 90° angles, but embodiments of this application need not have the layers cross at substantially 90° angles, but could instead cross at angles less than or greater than 90°.

In other embodiments, including a variety of soft materials along with hard surfaced resin impregnated laminated Anti-Ballistic materials, such as those sold by Du Pont under the registered trademark KEVLAR® and will still remain within the scope of this application.

Additionally, each of the Anti-Ballistic short side panels 125*a*, Anti-Ballistic long side panels 125*b*, and Anti-Ballistic bottom side panel 125*c* may also be fabricated using not only aramid fibers and KEVLAR® from DuPont, but also polyethylene fibers and GOLD SHIELD®, which is a KEVLAR® based material, and SPECTRA SHIELD®, which is polyethylene based material, both available commercially from Honeywell. GOLD SHIELD® and SPECTRA SHIELD® are high strength synthetic fibers impregnated in partially cured resin for use in ballistic material.

Moreover, both of the Honeywell materials can be used as layered soft armor or can be resin bonded, hot dye pressed synthetic fibers to form hard armor when they are autoclaved or compression molded into Anti-Ballistic components for construction of one or more of the Anti-Ballistic short side panels 125*a*, Anti-Ballistic long side panels 125*b*, and Anti-Ballistic bottom side panel 125*c*.

Additionally, in some embodiments, one or more of one or more of the Anti-Ballistic short side panels 125*a*, Anti-Ballistic long side panels 125*b*, and Anti-Ballistic bottom side panel 125*c* may be formed from a transparent Anti-Ballistic material such as a bullet proof glass or polycarbonate material such as materials sold by Saint-Gobain-Sully under the trade names ""Diamant" and/or "security glass", which are typically used in commercial armored vehicles and security trucks. For example, the Anti-Ballistic long side panel 125*b* may be formed from a transparent Anti-Ballistic Material in some embodiments. In such an embodiment, the outer sidewall 145 on the long side of the body 110 may be omitted so that a transparent, Anti-Ballistic window is formed in a long side of the Anti-Ballistic Case 100.

In the above discussed embodiments, the Anti-Ballistic handling case 100 includes both side panels 145 and Anti-Ballistic side panels 130. However, in some embodiments, the side panels 145 may be omitted and the Anti-Ballistic side panels 130 may form the exterior and interior walls of the Anti-Ballistic handling case 100, as may be apparent to a person of ordinary skill in the art.

Other similar materials or configurations of materials with similar purpose and function may be readily apparent to a person of ordinary skill in the art.

In some configurations, a person may be able to hide behind or inside of an Anti-Ballistic handling case according to one or more embodiments of the present disclosure. If such Anti-Ballistic Handling Cases are able to resist and absorb the impact of handgun or rifle bullets, a person hiding behind or within may be protected from being injured or killed by gunfire in a shooting.

The Anti-Ballistic case 100 and components shown in the drawings and described in detail herein disclose arrangements of elements of particular construction and configuration for illustrating embodiments of structure and method of operation of the present application. It is to be understood, however, that elements of different construction and configuration and other arrangements Anti-Ballistic cases in accordance with the spirit of this thereof other than those illustrated and described may be employed for providing disclosure, and such changes, alternations and modifications as would occur to those skilled in the art are considered to be within the scope of this design as broadly defined in the appended claims.

The abstract and any summaries provided herein are not intended to limit the scope of the present application, which is measured by the claims. For example, the above discussed embodiments were described in terms of a horizontal case having a body portion and a lid portion attached to the top of the body portion. However, other embodiments be a vertical case having a body portion and a door portion attached to a front or side of the body and the orientation or configuration of the case illustrated in the above discussed embodiment should not be interpreted as limiting the embodiments.

What is claimed is:

1. An Anti-Ballistic Handling Case comprising a body having a plurality of rigid body side walls forming a hollow interior region;

a lid having a plurality of a rigid lid side walls, wherein the lid is attached to the body and configured to cover the body to enclose the hollow interior region of the body;

an anti-ballistic portion formed of an anti-ballistic material disposed adjacent to at least one of: the plurality of body side walls, and the plurality of lid side walls, the anti-ballistic portion comprising an anti-ballistic body insert configured for insertion into the hollow interior of the body to contact at least two of the plurality of rigid body side walls; and an inner liner configured for removable insertion within the anti-ballistic portion such that the anti-ballistic portion is disposed between the inner liner and at least one of the plurality of body side walls and the plurality of lid side walls the anti-ballistic portion comprising a plurality of separate anti-ballistic body side panels, each of the plurality of anti-ballistic body side panels is formed from an anti-ballistic material;

wherein each of the plurality of separate anti-ballistic body side panels is orthogonally attached to at least two other adjacent anti-ballistic body side panels to form at least a partial box structure defining a hollow anti-ballistic chamber within the anti-ballistic handling case, and wherein each of the plurality of separate anti-ballistic body side panels is orthogonally attached by one or more of: adhesive, brackets, or fastening members.

2. The Anti-Ballistic Handling case of claim 1, wherein the anti-ballistic body insert further comprises an anti-ballistic bottom panel formed from an anti-ballistic material, is attached to at least one of the plurality of anti-ballistic body side panels, and contacts a bottom of the hollow interior of the body.

3. The Anti-Ballistic Handling case of claim 1, wherein the plurality of lid side walls of the lid define a hollow interior within the lid; and wherein the anti-ballistic portion is an anti-ballistic lid insert configured to be inserted into the hollow interior within the lid and contact at least one of the plurality of lid side walls, the anti-ballistic lid insert comprising:

a plurality of anti-ballistic lid side panels, wherein each of the plurality of anti-ballistic lid side panels is formed from an anti-ballistic material, and is attached to at least two other anti-ballistic lid side panels to form at least a partial box structure defining a hollow anti-ballistic chamber within the anti-ballistic handling case.

4. The Anti-Ballistic Handling case of claim 3, wherein the anti-ballistic lid insert further comprises an anti-ballistic top panel formed from an anti-ballistic material, and is attached to at least one of the plurality of anti-ballistic lid side panels.

5. The Anti-Ballistic Handling case of claim 4, wherein the anti-ballistic top panel is formed from a transparent anti-ballistic material;

wherein the lid includes an opening formed in a upper surface; and wherein the anti-ballistic top panel is aligned with the opening to form an anti-ballistic window in the lid.

6. The Anti-Ballistic Handling Case of claim 1, wherein the lid is attached to the body by at least one hinge member.

7. The Anti-Ballistic Handling Case of claim 1, further comprising a strut configured to actuate the lid between an open and a closed configuration.

8. The Anti-Ballistic Handling Case of claim 7, wherein the strut is an electronic strut configured to be remotely activated to actuate the lid between the open configuration and the closed configuration.

9. The Anti-Ballistic Handling case of claim 1, further comprising a latch mechanism configured to secure the lid to the body in a closed configuration.

10. The Anti-Ballistic Handling case of claim 9, wherein the latch mechanism is a biometric lock.

11. The Anti-Ballistic Handling case of claim 9, wherein the latch mechanism is a remote activated electronic lock.

12. The Anti-Ballistic Handling case of claim 1, further comprising at least one wheel attached to a bottom of the body.

13. The Anti-Ballistic handling case of claim 1, wherein the anti-ballistic portion comprises an anti-ballistic panel attached to an inner surface of each of the plurality of body side walls.

14. The Anti-Ballistic handling case of claim 1, wherein the anti-ballistic portion comprises an anti-ballistic panel attached to an inner surface of each of the plurality of lid side walls.

15. The Anti-Ballistic handling case of claim 1, wherein the anti-ballistic material comprises high strength synthetic fibers laid in at least two different directions.

16. The Anti-Ballistic handling case of claim 15, wherein the high-strength synthetic fibers include aramid fibers.

17. The Anti-Ballistic handling case of claim 15, wherein the high-strength synthetic fibers include polyethylene fibers.

18. The Anti-Ballistic handling case of claim 15, wherein the high-strength synthetic fibers include a combination of polyethylene and aramid fibers.

19. The Anti-Ballistic handling case of claim 15, wherein the anti-ballistic material comprises a plurality of sheets of high-strength synthetic fibers layered such that fibers of adjacent sheets are laid in different directions.

20. The Anti-Ballistic handling case of claim 15, wherein the high strength synthetic fibers are resin bonded and hot dye pressed to form hard armor sheets.

21. Anti-Ballistic container comprising a body forming a hollow interior region, the body comprising a frame, and a plurality of rigid body side walls attached to the frame;

a lid having a plurality of rigid lid side walls, wherein the lid is attached to the body and configured to cover the body to enclose the hollow interior region of the body;

an anti-ballistic portion formed of an anti-ballistic material disposed adjacent to at least one of: the plurality of body side walls, and the plurality of lid side walls, the anti-ballistic portion comprising an anti-ballistic body insert configured for insertion into the hollow interior of the body to contact at least two of the plurality of rigid body side walls; and an inner liner configured for removable insertion within the anti-ballistic portion such that the anti-ballistic portion is disposed between the inner liner and at least one of the plurality of body side walls and the plurality of lid side walls;

the antiballistic portion comprising a plurality of separate anti-ballistic body side panels, each of the plurality of anti-ballistic body side panels is formed from an anti-ballistic material;

wherein each of the plurality of separate anti-ballistic body side panels is orthogonally attached to at least two other adjacent anti-ballistic body side panels to form at least a partial box structure defining a hollow anti-ballistic chamber within the anti-ballistic handling case, and wherein each of the plurality of separate anti-ballistic body side panels is orthogonally attached by one or more of: adhesive, brackets, or fastening members.

22. The Anti-Ballistic container of claim 21, wherein the anti-ballistic body insert further comprises an anti-ballistic bottom panel formed from an anti-ballistic material, is attached to at least one of the plurality of anti-ballistic body side panels, and contacts a bottom of the hollow interior of the body.

23. The Anti-Ballistic container of claim 21, wherein the plurality of lid side walls of the lid define a hollow interior within the lid; and wherein the anti-ballistic portion is an anti-ballistic lid insert configured to be inserted into the hollow interior within the lid and contact at least one of the plurality of lid side walls, the anti-ballistic lid insert comprising:

a plurality of anti-ballistic lid side panels, wherein each of the plurality of anti-ballistic lid side panels is formed from an anti-ballistic material, and is attached to at least two other anti-ballistic lid side panels to form at least a partial box structure defining a hollow anti-ballistic chamber within the anti-ballistic handling case.

24. The Anti-Ballistic container of claim 23, wherein the anti-ballistic lid insert further comprises an anti-ballistic top panel formed from an anti-ballistic material, and is attached to at least one of the plurality of anti-ballistic lid side panels.

25. The Anti-Ballistic container of claim 24, wherein the anti-ballistic top panel is formed from a transparent anti-ballistic material;

wherein the lid includes an opening formed in a upper surface; and wherein the anti-ballistic top panel is aligned with the opening to form an anti-ballistic window in the lid.

26. The Anti-Ballistic container of claim 21, wherein the lid is attached to the body by at least one hinge member.

27. The Anti-Ballistic container of claim 21, further comprising a strut configured to actuate the lid between an open and a closed configuration.

28. The Anti-Ballistic container of claim 27, wherein the strut is an electronic strut configured to be remotely activated to actuate the lid between the open configuration and the closed configuration.

29. The Anti-Ballistic container of claim 21, further comprising a latch mechanism configured to secure the lid to the body in a closed configuration.

30. The Anti-Ballistic container of claim 29, wherein the latch mechanism is a biometric lock.

31. The Anti-Ballistic container of claim 29, wherein the latch mechanism is a remote activated electronic lock.

32. The Anti-Ballistic container of claim 21, further comprising at least one wheel attached to a bottom of the body.

33. The Anti-Ballistic container of claim 21, wherein the anti-ballistic portion comprises an anti-ballistic panel attached to an inner surface of each of the plurality of body side walls.

34. The Anti-Ballistic container of claim 21, wherein the anti-ballistic portion comprises an anti-ballistic panel attached to an inner surface of each of the plurality of lid side walls.

35. The Anti-Ballistic container of claim 21, wherein the anti-ballistic material comprises high strength synthetic fibers laid in at least two different directions.

36. The Anti-Ballistic container of claim 35, wherein the high-strength synthetic fibers include aramid fibers.

37. The Anti-Ballistic container of claim 35, wherein the high-strength synthetic fibers include polyethylene fibers.

38. The Anti-Ballistic container of claim 35, wherein the high-strength synthetic fibers include a combination of polyethylene and aramid fibers.

39. The Anti-Ballistic container of claim 35, wherein the anti-ballistic material comprises a plurality of sheets of high-strength synthetic fibers layered such that fibers of adjacent sheets are laid in different directions.

40. The Anti-Ballistic container of claim 35, wherein the high strength synthetic fibers are resin bonded and hot dye pressed to form hard armor sheets.

* * * * *